United States Patent [19]

Leon et al.

[11] 4,449,482

[45] May 22, 1984

[54] FLUIDIZED BED BOILERS

[75] Inventors: Albert M. Leon, Mamaroneck, N.Y.; Daniel E. McCoy, Williamsport, Pa.

[73] Assignee: Dorr-Oliver Incorporated, Stamford, Conn.

[21] Appl. No.: 372,853

[22] Filed: Apr. 28, 1982

[51] Int. Cl.[3] ..... F22B 1/02; F23D 19/02

[52] U.S. Cl. ..... 122/4 D; 110/255; 110/259

[58] Field of Search ..... 122/4 D; 110/245, 165 R, 110/166, 255, 259, 263

[56] References Cited

U.S. PATENT DOCUMENTS

| | | | |
|---|---|---|---|
| 2,097,268 | 10/1937 | Best | 122/347 |
| 3,983,927 | 10/1976 | Steever et al. | 122/4 D |
| 4,167,918 | 9/1979 | Atabay | 122/4 D |
| 4,184,455 | 1/1980 | Talmud et al. | 110/263 |
| 4,250,839 | 2/1981 | Daman | 122/4 D |
| 4,253,425 | 3/1981 | Gamble et al. | 122/4 D |
| 4,267,801 | 5/1981 | Robinson | 122/4 D |
| 4,268,244 | 5/1981 | Dawson | 122/4 D |
| 4,287,838 | 9/1981 | Frosch | 122/4 D |
| 4,301,771 | 11/1981 | Jukkola et al. | 122/4 D |
| 4,357,907 | 11/1982 | Campbell, Jr. et al. | 122/4 D |

*Primary Examiner*—Henry C. Yuen

*Attorney, Agent, or Firm*—Harold M. Snyder; Burtsell J. Kearns

[57] ABSTRACT

A fluidized bed boiler having a water-wall type construction has a steam-water natural circulation system for heat exchange. Vertical in-bed heat exchange tubes are provided and the steam drum of the boiler extends across the full length of the boiler combustion chamber and the convection heat exchange chamber. An air distributor grate is provided for introduction of fluidizing air into the combustion chamber and the air flow therefrom can be controlled to afford a flexible turndown capability.

4 Claims, 9 Drawing Figures

FLUIDIZED BED BOILERS

This invention is directed to fluidized bed boilers having a relatively wide range of turn-down capability.

BACKGROUND OF THE INVENTION

Fluidized bed reactors are effective means for generating heat and, in various forms, can carry out the processes of drying, roasting, calcining, heat treatment of solids with gases in the chemical, metallurgical, and other material processing fields, and the generation of hot gases, including steam, for use in driving electric power generation equipment, for process heat, for space heating or for other purposes. In reactors generating hot gases, air is passed through a bed of particulate material which includes a mixture of inert material and a fuel material such as coal, wood waste or other combustible materials. Where the combustion of bituminous or anthracite coal or other fuels containing a high sulfur component is undertaken, a material such as lime or limestone which will react with the sulfur released by combustion may be provided in the bed.

Fluidized bed reactors typically comprise a vessel having a substantially horizontal perforate plate; i.e., an air distributor or constriction plate, which supports a bed of particulate solids in the reaction chamber and separates the reaction chamber from a windbox below the plate. Combustion air is introduced into the windbox and passes through the air distributor in sufficient volume to achieve a gas velocity that expands or fluidizes the solids bed, suspending the particulate solids of the bed in the flowing air stream and imparting to the individual particles a continuous random motion. A fluidized bed in appearance and properties resembles a boiling liquid. Some important advantages of conducting a combustion reaction in a fluidized bed include the substantially uniform bed temperature, combustion at relatively low temperatures and a high heat transfer rate.

Commonly in such fluidized bed installations, the in-bed heat exchange tubes are disposed in a serpentine configuration with the lengths of the tubes extending in horizontal orientation; i.e., parallel to the upper surface of the fluidized bed. This kind of arrangement requires that the working fluid be pumped to assure satisfactory circulation of the water and steam through the system. The energy required to operate the pumps is a charge against the process. It is also well-known that horizontal in-bed tubes in serpentine configuration are susceptible to destructive erosion, especially at the return bends inherent in such arrays.

A disadvantage of typical fluidized bed boilers when compared with conventional boilers is due to the usual provision of a windbox below the combustion chamber. The windbox adds substantially to the total height of the unit so that additional clearance must be provided for prior art fluidized bed boilers.

Then, too, the flexibility in turn-down capability of known fluidized bed boilers has been limited. It is desirable at times to operate a boiler at substantially less than full capacity. While this can be achieved in conventional boilers by reducing the amount of air supplied, only a very modest change in capacity can be effected by this means in fluidized bed boilers, because the air supply must be maintained at a level sufficient to maintain the bed solids in a fluidized state. If the fluidized bed slumps, output of the unit ceases.

SUMMARY OF THE INVENTION

In accordance with this invention, a fluidized bed boiler is provided having natural circulation, completely watercooled, sealwelded bed containment, vertical in-bed tubes and zoning of the fluidizing air without segmenting the bed proper.

More particularly, the fluidized bed boiler of the invention comprises a housing, a reaction chamber within said housing, an air distributor or grate in the lower portion of said reaction chamber comprising a plurality of spaced sparge pipes, a fluidized bed region immediately above said grate which, in operation, contains a bed of solid particulate material, feed means for supplying solid particulate matter to said fluidized bed region, a freeboard region extending upward from said fluidized bed region to the top of said housing, a convection heat exchange chamber in horizontal communication with said freeboard region, a horizontally oriented steam drum extending through said freeboard region at the top thereof into the top of said convection heat exchange chamber, a horizontally oriented water drum extending across the bottom of said convection chamber, at least one water header below said grate in the reaction chamber, water-cooled walls being provided in said reaction chamber and said convection heat exchange chamber by tube and web panels, the vertically oriented tubes of said panels joining the water header or headers of said reaction chamber to said steam drum, convection bank tubes joining said water drum to said steam drum in said convection heat exchange chamber, a plurality of vertically oriented heat exchange tubes connected at the lower end thereof to said water header passing through said grate between adjacent sparge pipes thereof and upwards into and through said fluidized bed region and said freeboard region to terminate in said steam drum, said heat exchange tubes being distributed in said combustion chamber so as to form a central firing aisle clear of heat exchanger tubes into which said feed means may introduce solid particulate fuel and other particulate feed, said sparge pipes being removably mounted in said housing and passing through said water-cooled walls, the tubes of said water-cooled wall in the region of penetration of said sparge pipes being splayed and of decreased diameter to accommodate passage of said sparge pipes, an air header located externally of said housing and connected to said sparge pipes, a plurality of air ports along the length of said sparge pipes for introduction of fluidizing air to fluidize the bed of particulate matter above said grate in said fluidized bed region, individually operable control means for each sparge pipe to open or close said sparge pipe to air flow, an exhaust stack communicating with said convection heat exchange chamber for exhausting combustion gases which have traversed said convection heat exchange chamber and an ash removal means communicating with said reaction chamber.

The ash removal means may comprise a trough beneath the water header or headers which extends below the length of the firing aisle and having at least one ash discharge screw. As ash discharge conduit is connected to the trough. The discharge screw is capable of moving ash which falls through the grate into the trough toward the discharge conduit for removal.

In another embodiment, the ash removal means may comprise a pair of opposed discharge screws located in the above-mentioned trough. The discharge screws move the ash in the trough toward the center of the trough. A discharge conduit is connected to the trough at the center thereof to receive the ash for removal.

DETAILED DESCRIPTION

Figure 1:
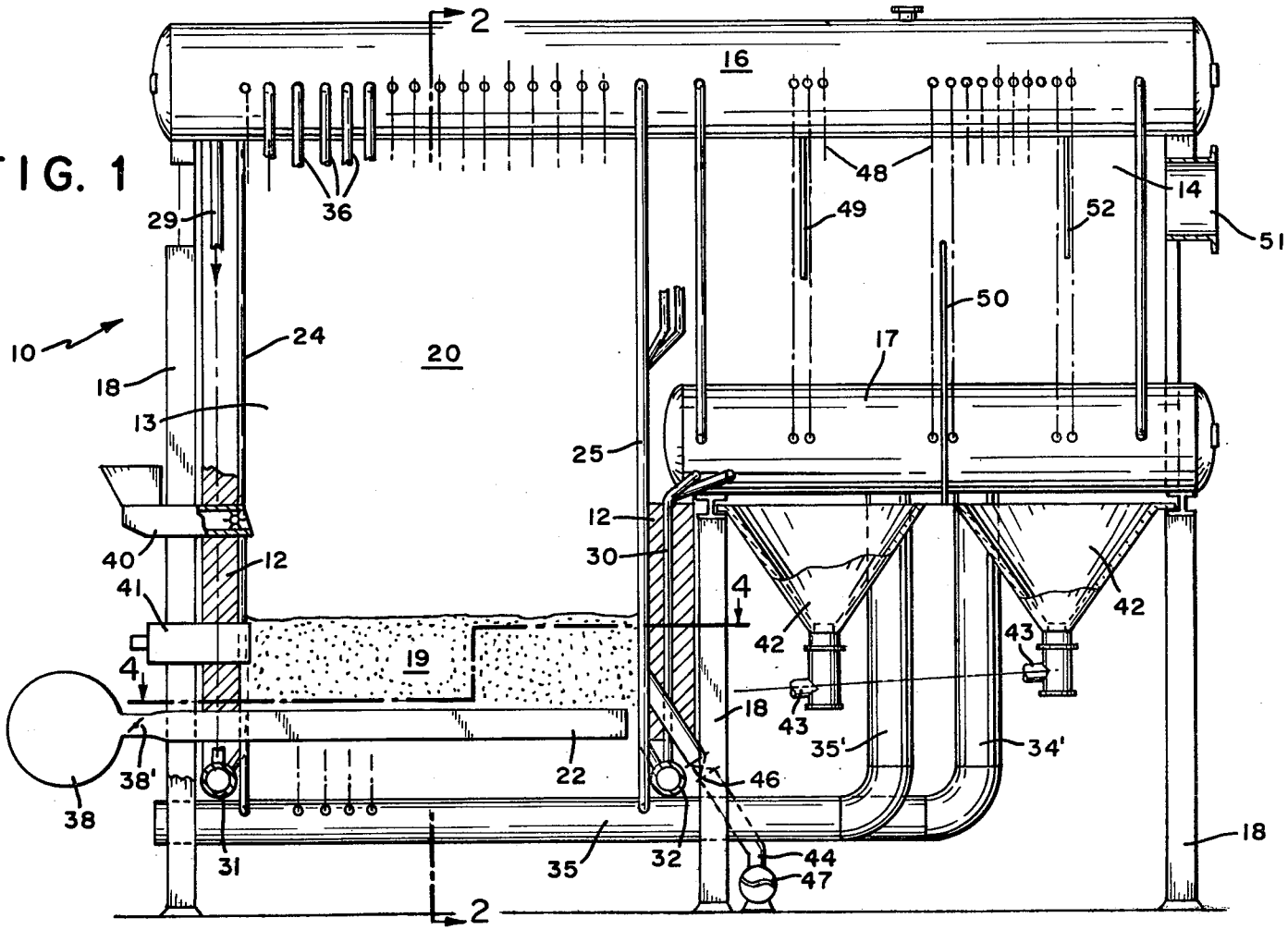
FIG. 1 is a elevational view, partially in section, of a fluidized bed boiler of the invention with much of the structure broken away to show interior structural detail.
Figure 2:
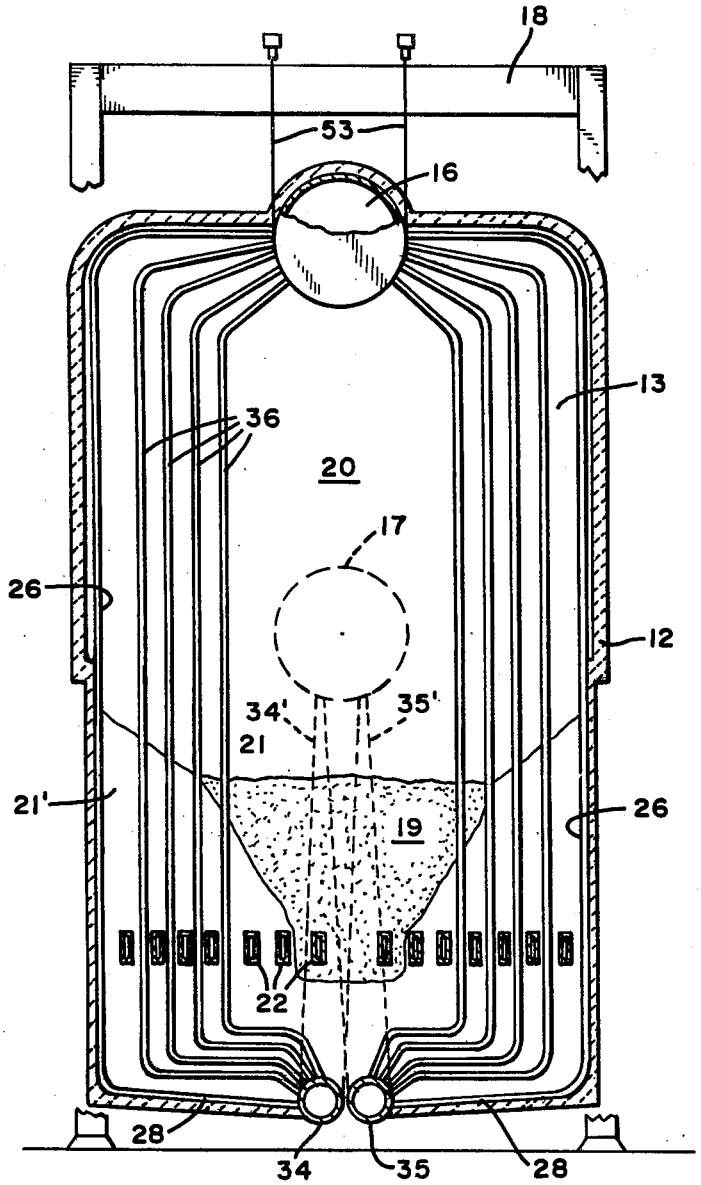
FIG. 2 is a view taken along line 2—2 of FIG. 1 showing, partially in section, the combustion compartment of the fluidized bed boiler.

Referring to the Figures, there is illustrated a fluidized bed boiler 10 including a combustion chamber 13 and a convection chamber 14. A steam drum 16 extends across the top of both the combustion chamber 13 and the convection chamber 14, while a water drum 17 is located at the bottom of the convection chamber 14 alone. A support structure 18 is provided for the boiler and as indicated in FIG. 2 the boiler may be suspended from support structure 18 by means such as wire rope 53.

Figure 4:
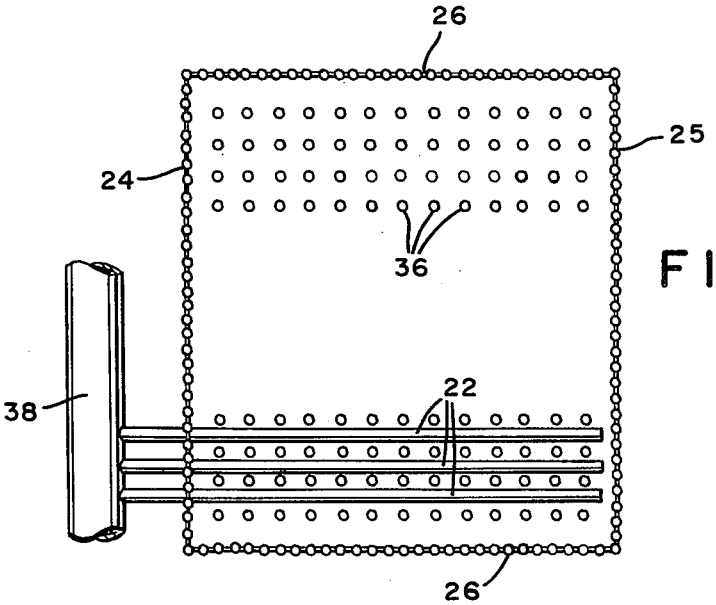
FIG. 4 is a view taken along line 4—4 of FIG. 1 showing, in plan, the arrangement of sparge pipes, in-bed heat exchange tubes and the water-wall containment.
Figure 9:
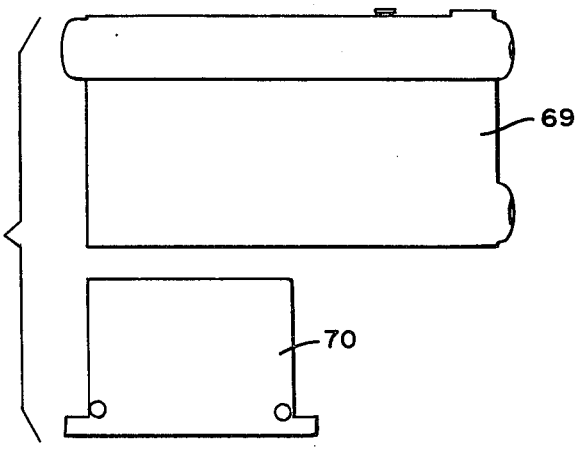
FIG. 9 is an outline sketch of two modules for shipping and assembly of the fluidized bed boiler of the invention.
Figure 5:
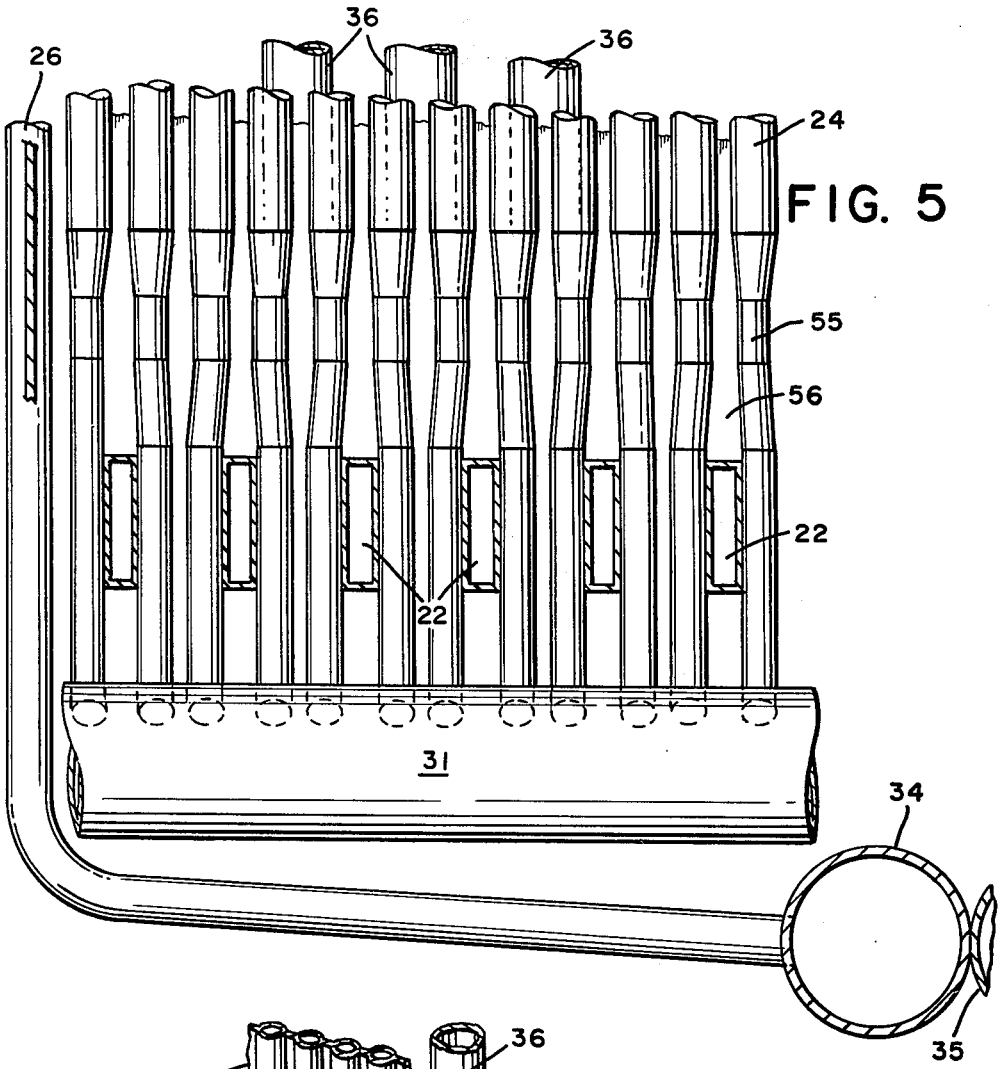
FIG. 5 is an elevational view, partially in section, showing details of water-wall construction.
Figure 6:
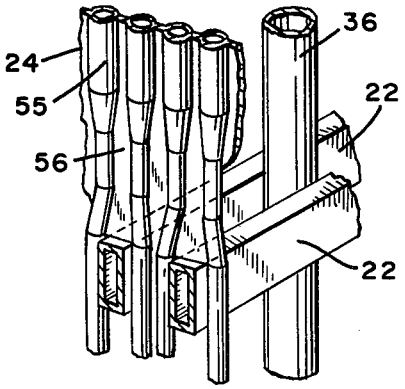
FIG. 6 is a broken view in perspective showing the spatial arrangement of certain elements of the invention.

The combustion chamber 13 will include a fluidized bed 19 and a freeboard region 20. The fluidized bed is supported by an array of sparge pipes 22 supplied with air by an air header 38. Containment of the combustion chamber 13 is provided by a weld-sealed water-wall structure in which a plurality of water-wall tubes 55 are connected by steel webbing 56 to form a membrane surrounding combustion chamber 13. The water flowing in the water-wall structure is supplied by headers 31, 32, 34 and 35. Downcomers 29 and 30 supply water to the headers from the steam drum 16 and the water drum 17, respectively. The view shown in FIG. 4 illustrates this containment structure with the front water wall 24 sealingly joined to side water-walls 26 and to bridge water-wall 25. Insulation 12 is provided outside the water-walls 24, 25, 26 to reduce heat loss and a sheet metal sheathing (not shown) may be provided to protect the insulation from the weather and other damage.

An overbed feeder 40 is provided for supplying fuel (coal, for example) and limestone to the combustion chamber 13 as is a start-up burner 41 to initiate combustion. Both of these devices penetrate the water-wall structure.

In-bed heat exchange tubes 36 are provided in combustion chamber 13. The heat exchange tubes 36 are vertically oriented and run from the headers 34, 35, upward through the array of sparge pipes 22, through the fluidized bed 19 and the freeboard region 20 to the steam drum 16.

In the convection chamber 14 a plurality of convection bank tubes 48 are provided to extract additional heat from the combustion gases and a plurality of convection baffles 49, 50, 52 are provided to cause the dust to drop out of the combustion gases. Dust hoppers 42 are provided to collect dust dropped out in the convection chamber 14 for reinjection into combustion chamber 13 through conduits 43.

Provision for ash disposal is made by connecting ash disposal conduit 44 to the fluid bed region 19 of the combustion chamber 13. The flow through the ash disposal conduit is controlled by valve 46 and a screw means 47 is provided to move the ash away from conduit 44 for disposal.

Downcomers 35' and 34' are connected to water drum 17 to supply water to headers 35 and 34, respectively.

In FIGS. 2, 4, 5 and 6 the relationship of the in-bed tubes 36 to the sparge pipes 22 and the water-wall 24, 25, 26 is shown in full detail. It should be noted, as seen in FIG. 2, that the capacity of the fluidized bed boiler 10 can be reduced by closing down a selected number of the sparge pipes 22. Usually the sparge pipes closest to the boiler walls will be shut down first and then those next closest to the walls, so that an inactive (or slumped) bed is formed against the boiler walls with the active bed near the center of the boiler combustion chamber. A turn down ratio of 1 to 7, for example, can readily be achieved with this fluidized bed boiler.

Turn-down capability may also be improved by careful selection of in-bed tube density along each side of combustion chamber 13. It is clear that as individual sparge pipes 22 are shut off from the sides toward the center, a disproportionate amount of in-bed tube surface may be removed from contact with active bed area. This permits a further reduction in the fuel feed and steam generation per unit of plan area.

It should be noted, as illustrated in FIG. 2, that a firing aisle clear of in-bed tubes is provided so that fuel and other materials can be introduced into combustion chamber 13 without impinging on the in-bed tubes. The water-cooled floor 28 of the combustion chamber 13 is clearly seen in FIG. 2.

Figure 3:
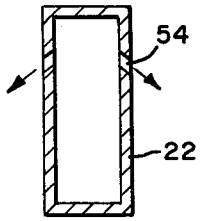
FIG. 3 is a view in section of a sparge pipe.

In FIG. 3, which shows a section of sparge pipe 22, the pots 54 are provided and each port may be inclined to direct air downwardly. Also, the ports should be located so as not to direct a jet of air, which can be extremely erosive, directly against an in-bed tube.

Figure 7:
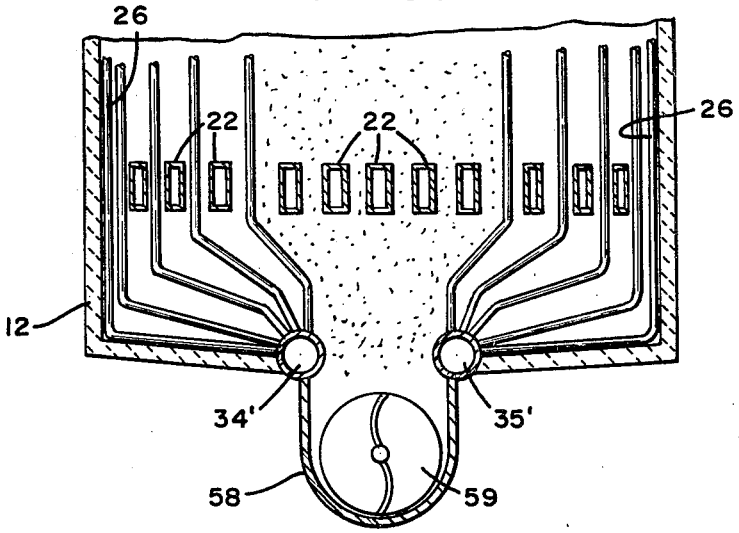
FIG. 7 is a view of a further embodiment of the invention with a modified ash disposal system.

FIG. 7 illustrates a modified version of the ash removal system. In this case, the water headers 34' and 35' are separated to accommodate a trough 58 into which ash drops. A screw drive means 59 is located in trough 58 to move ash out of the combustion chamber for disposal.

Figure 8:
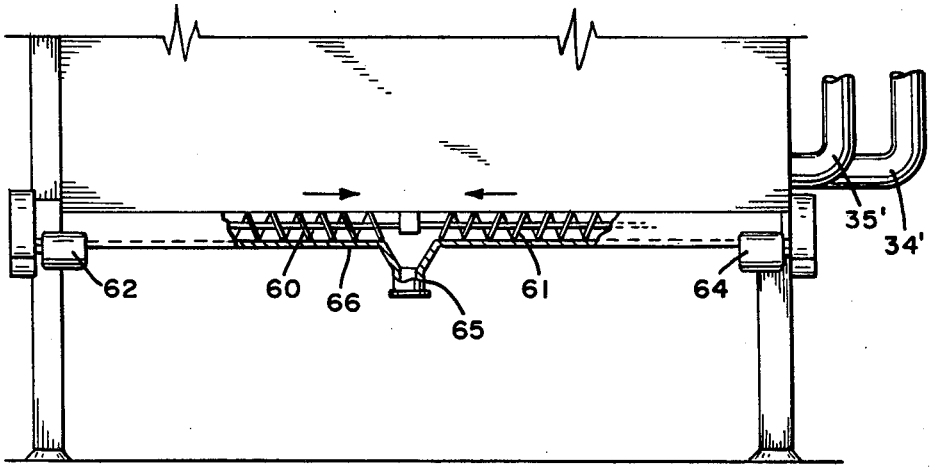
FIG. 8 shows another embodiment of the invention in which opposed ash discharge screws are provided.

In FIG. 8 a further modification of the ash removal system is shown in which opposed screw drive means 60 and 61 are provided in trough 66. Electric motors 62 and 64 drive the screw drive means 60 and 61, respectively. The screw drive means 60 and 61 move the ash toward the center of trough 66 for removal through ash discharge port 65 provided at that point.

It is expressly understood that the present invention is not limited to the embodiment illustrated and described. Various changes can be made in the design and arrangement of parts without departing from the spirit and scope of the invention as the same will now be understood by those skilled in the art.

We claim:

1. A fluidized bed boiler comprising a housing, a reaction chamber within said housing, an air distributor or grate in the lower portion of said reaction chamber comprising a plurality of spaced sparge pipes, a fluidized bed region immediately above said grate which, in operation, contains a bed of fluidized solid particulate material, a shielding region below said grate which, in operation, is occupied by a body of quiescent particulate material resting on the bottom of said housing, feed means for supplying solid particulate matter to said fluidized bed region, a freeboard region extending upward from said fluidized bed region to the top of said housing, a convection heat exchange chamber in horizontal communication with said freeboard region, a horizontally oriented steam drum extending through said freeboard region at the top thereof into the top of said convection heat exchange chamber, a horizontally oriented water drum extending across the bottom of said convection chamber, at least one water header below said grate in the reaction chamber, water-cooled walls being provided in said reaction chamber and said convection heat exchange chamber by tube and web panels, the vertically oriented tubes of said panels joining the water header or headers of said reaction chamber to said steam drum, convection bank tubes joining said water drum to said steam drum in said convection heat exchange chamber, a plurality of vertically oriented heat exchange tubes connected at the lower end thereof to said water header and passing through said shielding region below said grate, between adjacent sparge pipes of said grate and vertically upward into and through said fluidized bed region and said freeboard region to terminate in said steam drum, said heat exchanged tubes in said shielding region being isolated by said quiescent body of particulate material therein from the erosive conditions prevailing in said fluidized bed region, said heat exchange tubes being distributed in said reaction chamber so as to form a central firing aisle clear of heat exchanger tubes into which said feed means may introduce solid particulate fuel and other particulate feed, said sparge pipes being removably mounted in said housing and passing through said water-cooled walls, the tubes of said water-cooled wall in the region of penetration of said sparge pipes being splayed and of decreased diameter to accommodate passage of said sparge pipes, an air header located externally of said housing and horizontally connected to said sparge pipes, a plurality of air ports along the length of said sparge pipes for introduction of fluidizing air to fluidize the bed of particulate matter above said grate in said fluidized bed region, individually operable control means for each sparge pipe to open or close said sparge pipe to air flow, an exhaust stack communicating with said convection heat exchange chamber for exhausting combustion gases which have traversed said convection heat exchange chamber and an ash removal means communicating with said reaction chamber.

2. The fluidized bed boiler of claim 1 wherein said sparge pipes are rectangular in cross-section with the longer axis of said cross-section oriented in a vertical direction and said air ports are located in the longer sides thereof as seen in cross-section.

3. The fluidized bed boiler of claim 1 wherein said ash removal means comprises a trough beneath said water headers which extends beneath the entire length of said firing aisle, at least one ash discharge screw located in said trough, and an ash discharge conduit connected to said trough, said discharge screw capable of moving ash which falls through said grate into said trough toward said discharge conduit.

4. The fluidized bed boiler of claim 1 wherein said ash removal means comprises a trough-like extension of the floor of said reaction chamber which extends beneath said firing aisle, a pair of discharge screws located in said trough capable of moving ash which falls into said trough from said fluidized bed towards the center of said trough, a discharge conduit connected to said trough at the center thereof.

* * * * *